US006702224B2

(12) United States Patent
Resta

(10) Patent No.: US 6,702,224 B2
(45) Date of Patent: Mar. 9, 2004

(54) MAGAZINE FOR A PLURALITY OF REELS OF TAPE PROVIDED WITH A DEVICE FOR SELECTING A REEL TO BE USED AND A REEL TO BE REPLACED

(75) Inventor: Roberto Resta, Faenza (IT)

(73) Assignee: Resta S.r.l., Faenza (IT)

( * ) Notice: Subject to any disclaimer, the term of this patent is extended or adjusted under 35 U.S.C. 154(b) by 0 days.

(21) Appl. No.: 10/043,251

(22) Filed: Jan. 14, 2002

(65) Prior Publication Data

US 2002/0092945 A1 Jul. 18, 2002

(30) Foreign Application Priority Data

Jan. 17, 2001 (IT) ..... BO2001A0014

(51) Int. Cl.[7] ..... B65H 19/12; B65H 23/10; B65H 16/00

(52) U.S. Cl. ..... 242/559.4; 242/419.4; 242/592

(58) Field of Search ..... 242/559, 559.1, 242/559.4, 419.4, 592, 597.7, 597.8, 563, 566, 550, 538

(56) References Cited

U.S. PATENT DOCUMENTS

| | | | | | |
|---|---|---|---|---|---|
| 204,692 | A | * | 6/1878 | White | 242/140 |
| 471,788 | A | * | 3/1892 | Farnsworth | 242/559 |
| 794,578 | A | * | 7/1905 | Wood | 242/555.2 |
| 991,827 | A | * | 5/1911 | Capers | 242/594.1 |
| 1,050,047 | A | * | 1/1913 | Walkup | 242/422.9 |
| 1,211,242 | A | * | 1/1917 | Schaffer | 242/594.1 |
| 1,830,669 | A | * | 11/1931 | Loomis | 242/441.2 |
| 2,242,810 | A | * | 5/1941 | Bostwick | 242/422.4 |
| 2,767,931 | A | * | 10/1956 | Woods et al. | 242/422.5 |
| 3,015,384 | A | * | 1/1962 | Kellogg | 242/588.6 |
| 3,480,343 | A | * | 11/1969 | Kanitz | 312/268 |
| 3,639,023 | A | * | 2/1972 | Anders et al. | 312/268 |
| 3,822,044 | A | * | 7/1974 | Riekkinen | 242/473.6 |
| 4,169,566 | A | * | 10/1979 | Boudouris et al. | 242/328.2 |
| 4,484,288 | A | * | 11/1984 | Riemenschneider | 700/230 |
| 4,650,264 | A | * | 3/1987 | Dahnert | 312/268 |
| 5,269,479 | A | * | 12/1993 | Budin et al. | 242/559.4 |
| 5,601,252 | A | * | 2/1997 | Draghetti | 242/559.1 |
| 5,938,145 | A | * | 8/1999 | Dueck | 242/559.4 |

OTHER PUBLICATIONS

Patent Abstracts of Japan, vol. 2000, No. 07, Sep. 29, 2000 –& JP 2000 118517 A (Toppan Label KK), Apr. 25, 2000* abstract; figures 1,2,4*.

* cited by examiner

*Primary Examiner*—Kathy Matecki
*Assistant Examiner*—Scott J. Haugland
(74) *Attorney, Agent, or Firm*—Guido Modiano; Albert Josif; Daniel O'Byrne

(57) ABSTRACT

A magazine for a plurality of reels of tape provided with a device for selecting a reel of tape to be used, comprising a plurality of supports for the reels, which can slide on a guide so that the reels form a stack whose axis is parallel to the guide, elements for actuating simultaneously the plurality of supports along the guide in order to position the reel of tape to be used in a preset point of the guide.

8 Claims, 7 Drawing Sheets

MAGAZINE FOR A PLURALITY OF REELS OF TAPE PROVIDED WITH A DEVICE FOR SELECTING A REEL TO BE USED AND A REEL TO BE REPLACED

BACKGROUND OF THE INVENTION

The present invention relates to a magazine for a plurality of reels of tape provided with a device for selecting a reel to be used and a reel to be replaced.

The invention is meant to have various applications. In particular, reference is made to the application of the magazine to the feeding of sewing machines, in which the tape is taken from a reel and sewn in order to trim, reinforce and finish an article. For example, in so-called mattress border stitching machines the tape is applied so as to cover the perimetric edges of the mattress. Currently, replacing the tape if the reel is depleted or replacing it with another one of a different type requires rather long times on the part of operators, due to the lack of immediate availability and promptness of preparation of the new reels.

SUMMARY OF THE INVENTION

The aim of the present invention is therefore to provide a magazine that is capable of storing a plurality of reels and is structured so as to allow to replace depleted reels and select the reel to be used in each instance.

Within this aim, an object of the present invention is to provide a magazine that can be combined with a sewing machine, particularly a mattress border stitching machine.

This aim and this and other objects which will become better apparent hereinafter are achieved with a magazine for a plurality of reels of tape provided with a device for selecting a reel of tape to be used, characterized in that it comprises a plurality of supports for said reels, which can slide on a guide so that said reels form a stack whose axis is parallel to said guide, means for actuating simultaneously said plurality of supports along said guide in order to position the reel of tape to be used in a preset point of said guide.

Advantageously, the supports are suitable to be moved independently of each other, so as to be able to move each individual reel into a position in which it is not aligned with said stack in order to be removed and/or replaced with another reel.

BRIEF DESCRIPTION OF THE DRAWINGS

Further characteristics and advantages of the present invention will become better apparent from the following description of a preferred but not exclusive embodiment thereof, illustrated only by way of non-limitative example in the accompanying drawings, wherein.

DESCRIPTION OF THE PREFERRED EMBODIMENTS

Figure 1:
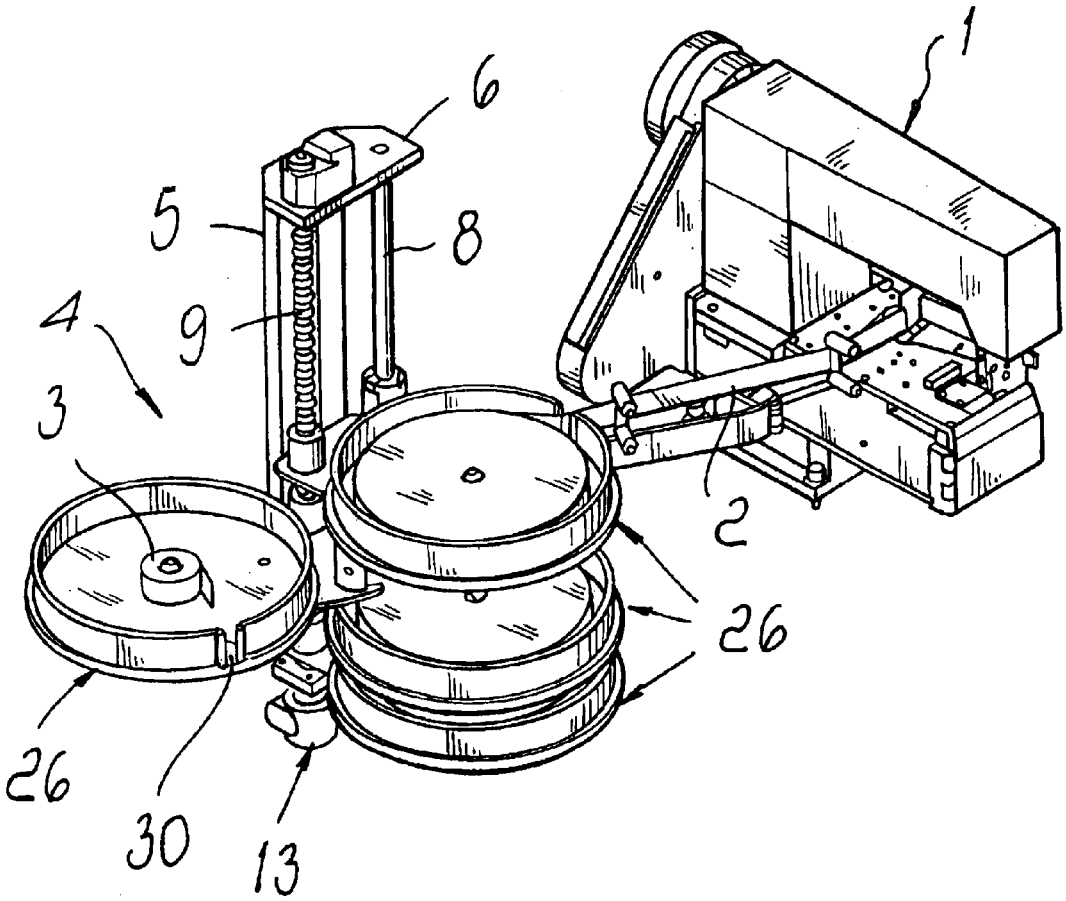
FIG. 1 is a perspective view of a magazine combined with a sewing machine for applying borders to mattresses.
Figure 2:
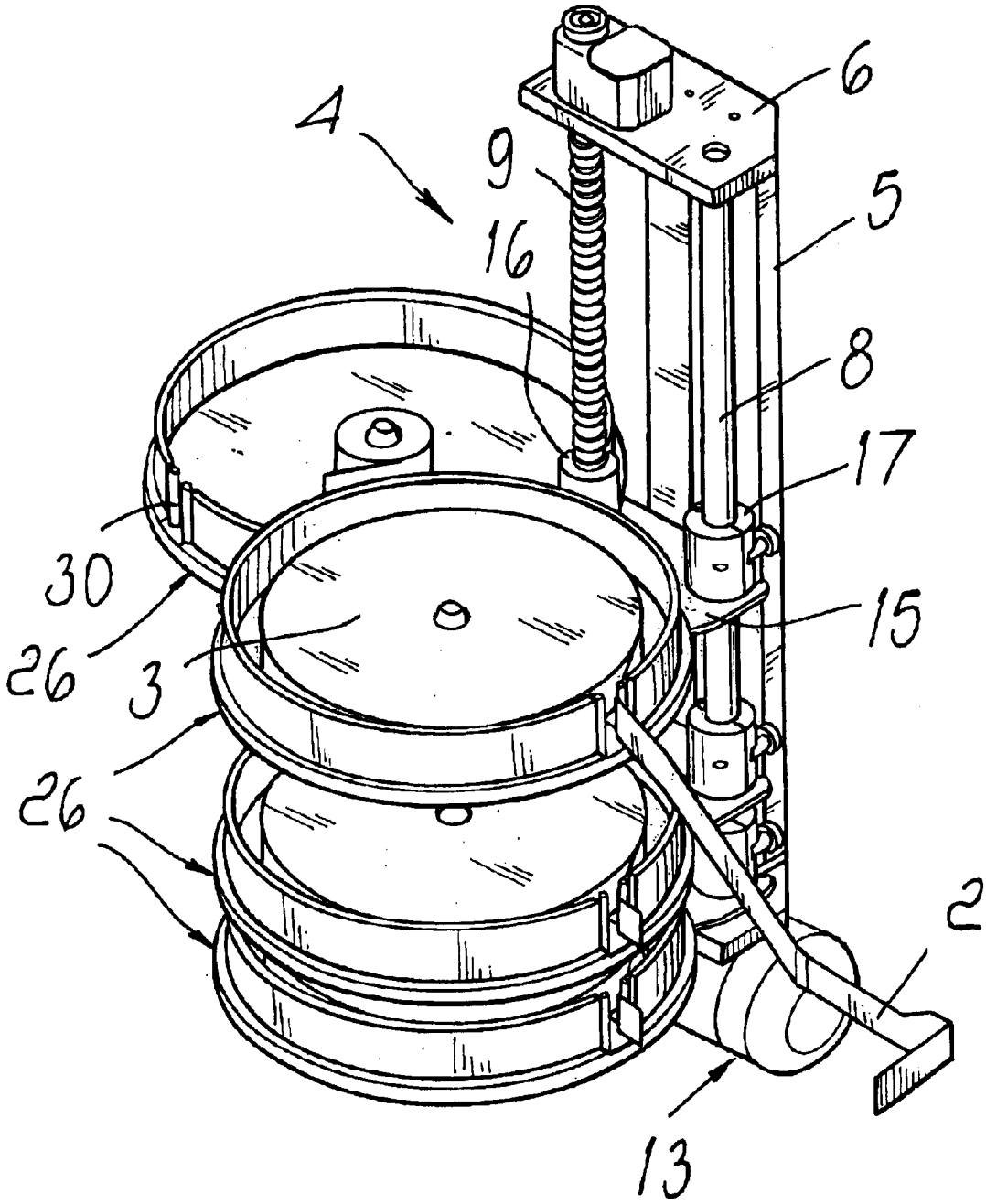
FIG. 2 is a perspective view of the magazine of FIG. 1, taken from another viewpoint.
Figure 4:
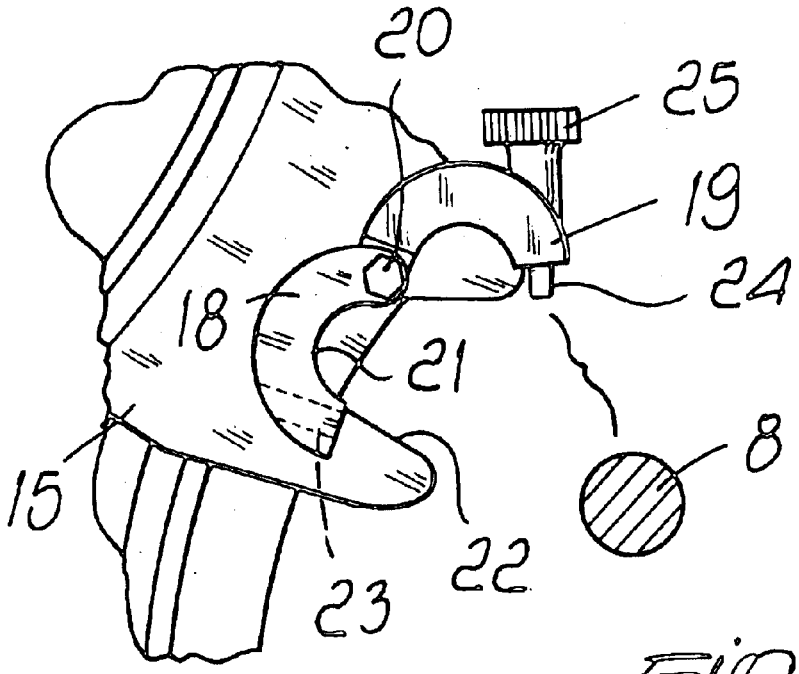
FIG. 4 is a plan view of the detail of FIG. 3 in a different operating position.

With reference to FIG. 1, the reference numeral 1 designates a known type of border stitching machine for applying borders to mattresses, i.e., for covering with a tape 2 the edges of a mattress. The machine consists of a sewing machine equipped with guiding and folding means, which guide the tape 2 to as to surround with it the edges of the mattress and allow their sewing in order to form a ridge that surrounds the mattress perimetrically.

The tape 2 is unwound from a reel 3, which together with other reels is contained in a magazine, generally designated by the reference numeral 4. As shown more clearly in FIGS. 2 to 5, the magazine 4 is composed of two vertical posts 5, with the upper and lower ends of which two respective brackets 6 and 7 are rigidly coupled.

The brackets 6 and 7 support a cylindrical bar 8 and a threaded rod 9, which are parallel. More specifically, the bar 8 has opposite ends inserted in seats of the brackets 6 and 7, while the threaded rod 9 is rotatably supported in the brackets 6 and 7 by means of bearings 10 and 11.

The threaded rod 9 is rotationally coupled to the output shaft 12 of a gearmotor 13, which is coupled by means of a flange under the lower bracket 7. The gearmotor 13 is of the reversible type in order to be able to actuate the rod 9 in both directions of rotation.

Multiple supports 14 can slide on the bar 8 and on the threaded rod 9; in the illustrated example, such supports are four, but their number can vary according to the requirements. Each support 14 is composed of a laminar arm 15, which is substantially triangular and is provided with an internally threaded bush or female thread 16 and with a sliding bush 17. The female thread 16 is engaged on the threaded rod 9, while the bush 17 slides on the bar 8. In this manner, the rotation of the rod 9 determines the sliding of the bush 17 on the bar 8, which accordingly acts as a guide.

Figure 3:
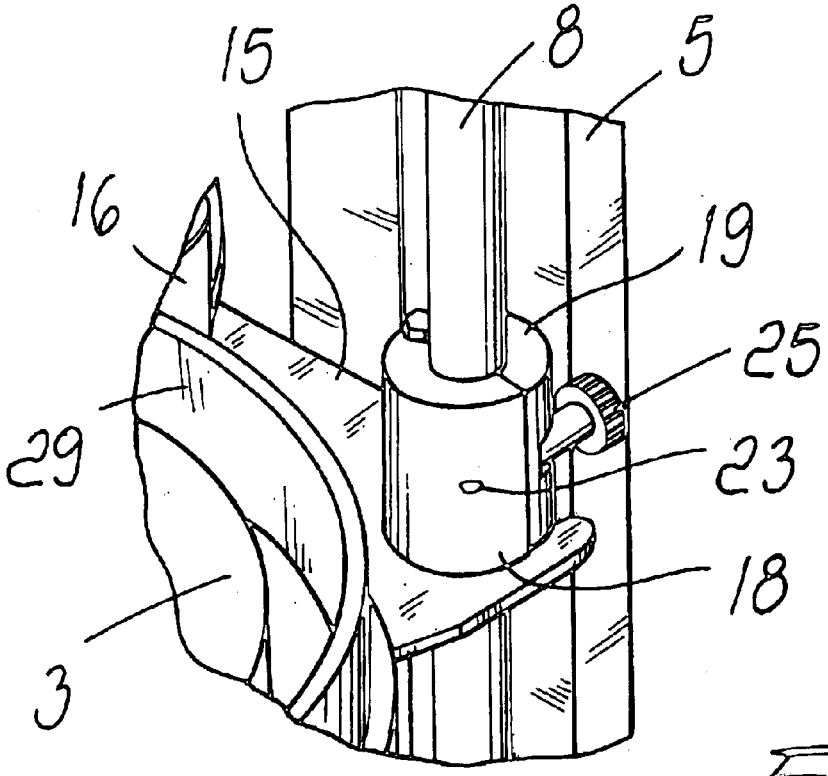
FIG. 3 is an enlarged-scale view of the detail enclosed in the circle of FIG. 2.
Figure 5:
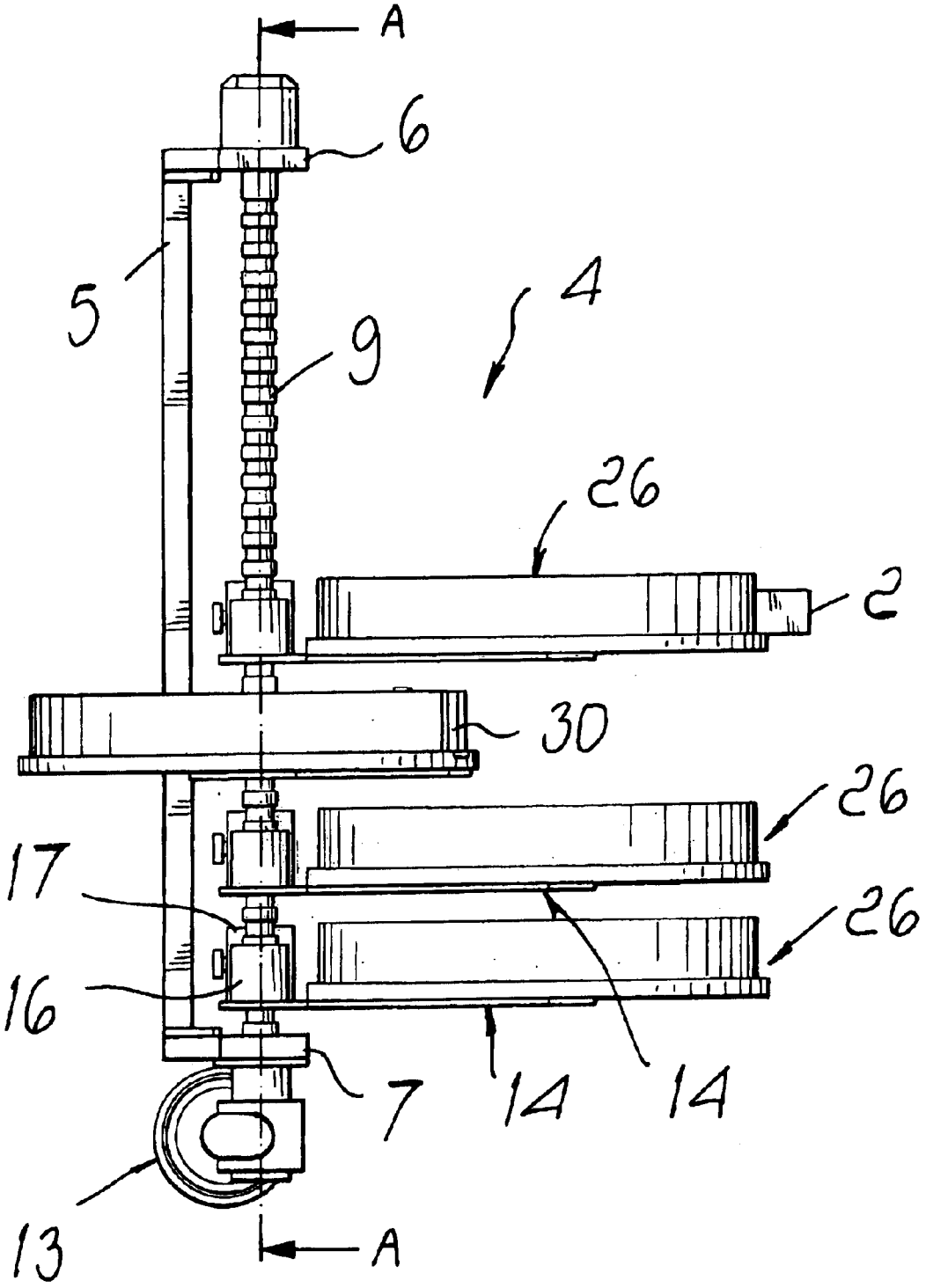
FIG. 5 is an elevation view of the magazine.
Figure 6:
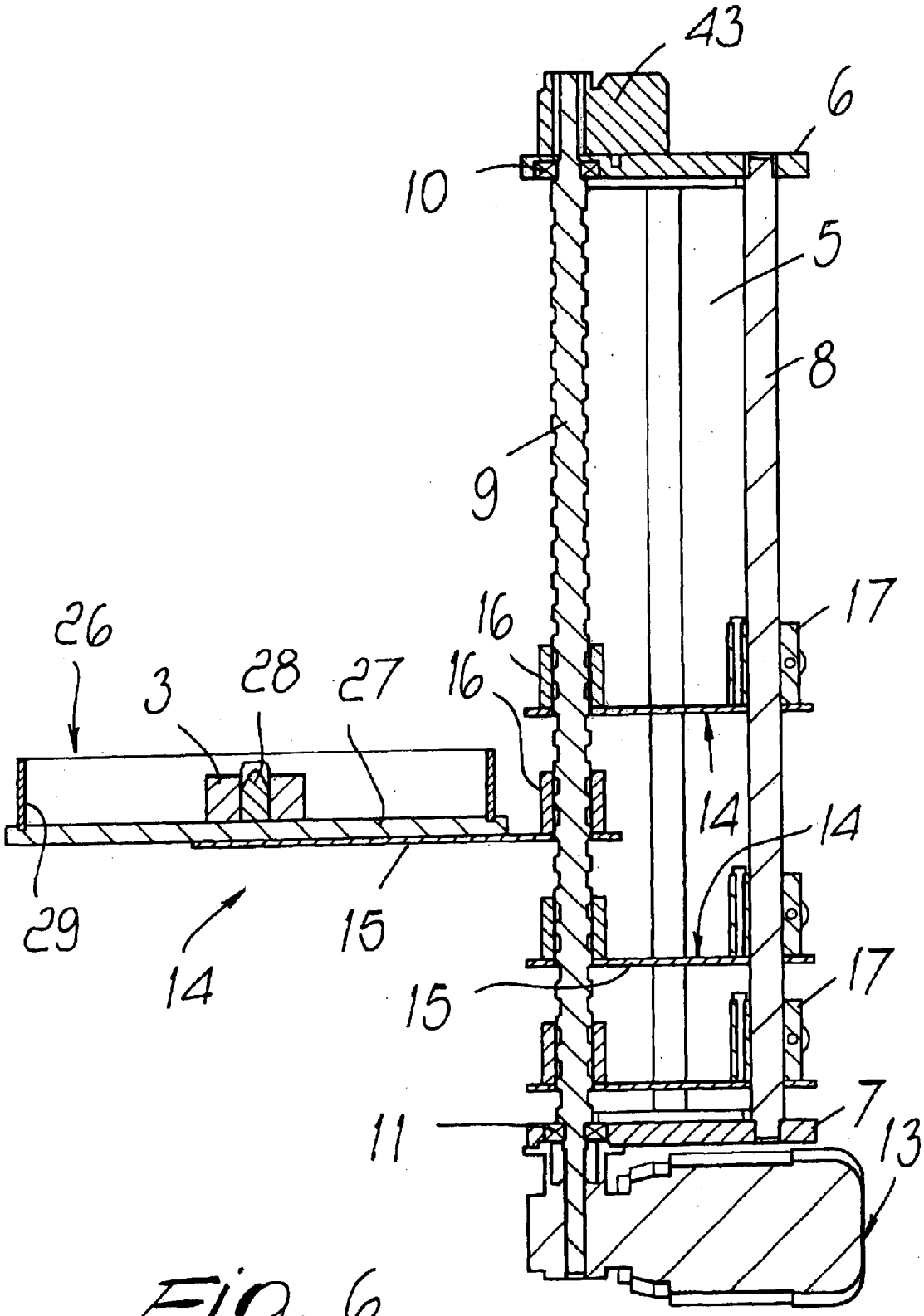
FIG. 6 is a sectional view, taken along the line A—A of FIG. 4.
Figure 7:
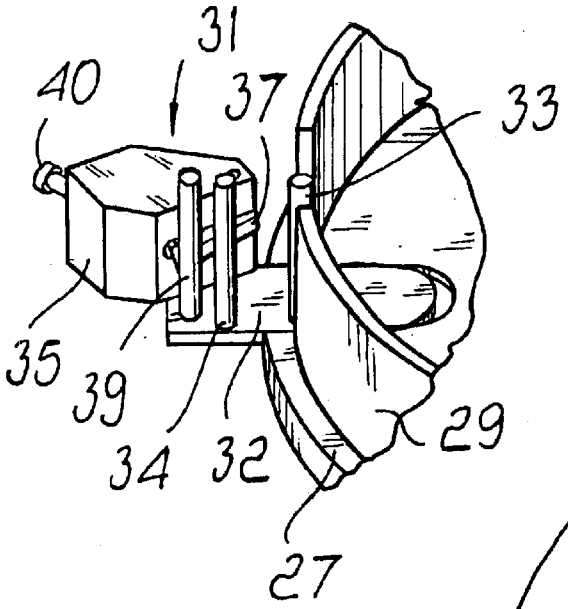
FIG. 7 is a view of a device combined with the magazine for tensioning the tape being unwound.
Figure 8:
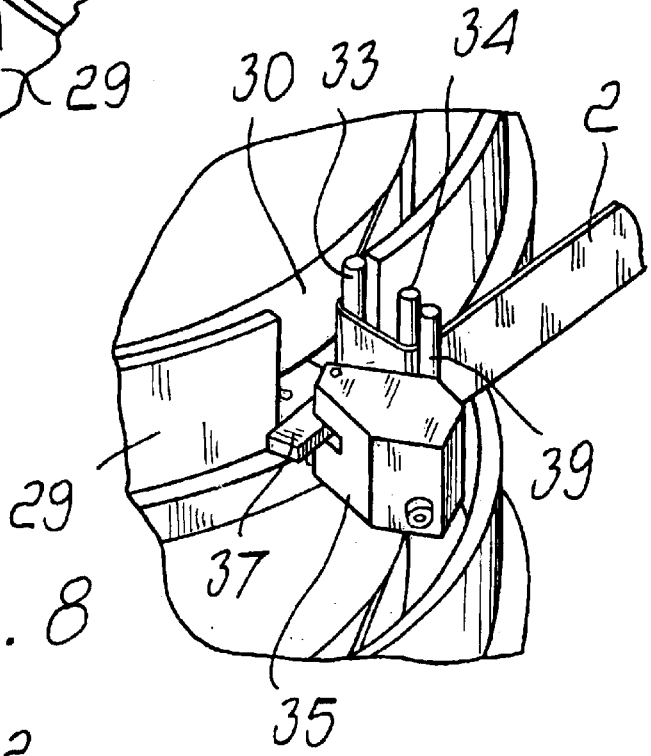
FIG. 8 is another view of the device of FIG. 7.
Figure 9:
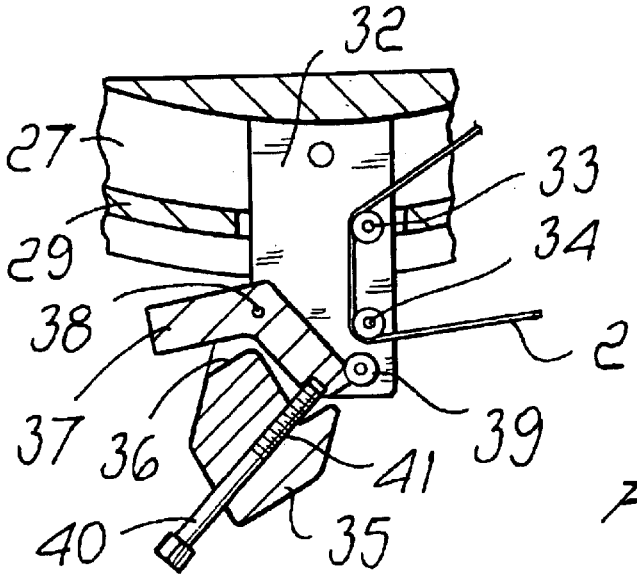
FIG. 9 is a sectional view of the device of FIGS. 7 and 8.

As shown more clearly in FIG. 3, the bush 17 is composed of two cylindrical half-shells 18 and 19, which are mutually pivoted by means of a pivot 20 that is parallel to the bar 8. The half-shell 19 can oscillate with respect to the half-shell 18, which is fixed to the arm 15 so that its semicylindrical cavity 21 is directed toward the bar 8. Likewise, on the arm 15 there is a recess 22, which allows the bar 8 to engage and exit from the cavity 21 of the half-shell 18.

In the sides of the half-shells 18 and 19 that lie opposite those crossed by the pivot 20 there is a threaded hole 23 and a screw 24 with a knob 25. When the half-shell 19 is turned in abutment against the half-shell 18, the screw 24 is screwed into the hole 23 so as to complete the closure of the bush 17 on the bar 8 and allow the axial movement of the arm 15 following the rotation of the threaded rod 9, preventing the arm 15 from rotating about the threaded rod 9.

Each arm 15 supports a container 26 for a respective reel 3 of tape 2. The container 26 is constituted by a circular plate 27; a centering pin 28 for the reel 3 rises centrally from the plate, and a cylindrical side wall 29, with a radial exit slit 30 for the tape 2, rises peripherally from said plate.

The operation of the described magazine is as follows.

When the magazine is full, i.e., when in each container 24 there is a respective reel 3, the bushes 17 of the supports 14 are closed on the bar 8 (see FIG. 2), so that the containers 26 form a stack whose axis is parallel to the bar 8.

When one wishes to feed the border stitching machine 1 with a tape 2, the gearmotor 13 is actuated and, by turning the threaded rod 9, lifts the entire stack of containers until the container that contains the intended tape is arranged at the level intended to ensure perfect guiding of the tape to the border stitching machine 1 (see FIG. 1).

If the drawn tape 2 is used up, the gearmotor 13 is reactivated in order to bring to the intended level a container 26 that contains a new reel. In the meantime, the bush 17 of the container whose reel has been depleted is opened by unscrewing the screw 24, so as to allow the arm 15 to turn into a position in which the container lies outside the stack and can be supplied with a new reel. The container thus replenished is returned to the stack with the others and rigidly coupled to the bar 8 by closing the bush 17.

A substantial advantage of the present invention is the fact that it allows not only the rapid replacement of depleted reels but also the replacement of one tape with another one that differs in terms of quality, material and dimensions.

Numerous modifications and variations are possible in the practical embodiment of the invention. In particular, by mutually spacing the supports 14 appropriately, it is possible to replace the reels while leaving the containers 26 stacked and therefore without having to use openable bushes such as the bushes 17 described in the above example.

In another version, the supports 14 are rotationally rigidly coupled to the bar 8 by bushes and the containers 26 are placed outside the stack by providing means that allow to move the containers with respect to the supports 14.

Advantageously, at the exit 30 of each container 26 there is a device 31 (see FIGS. 7–10) for adjusting the tension applied by the sewing machine 1 to the tape 2 being fed. Such device is constituted by a bracket 32, which is fixed to the plate 27 and protrudes from the exit slit 30. Two pins 33, 34 for guiding the unwound tape 2 are fixed to the bracket 32 at right angles thereto. The pin 33 is located in the slit 30 on the plane of the side wall 29, while the pin 34 is mounted on the bracket 32 on the outside of the container.

A block 35 is also fixed to the bracket 32 and is provided with a seat 36 in which a lever 37 is articulated; the lever oscillates about a pivot 38 that is perpendicular to the bracket.

The lever 37 has a first arm, with the end of which a bar 39, parallel to the pin 34, is rigidly coupled. The pin 34 lies within the rotational arc of the bar 39, so that the bar provides a sort of presser that acts on the tape 2 guided between the bar 39 and the pin 34, retaining it by friction.

The friction is obtained by means of a screw 40, which acts on the lever 37 with the interposition of a spring 41 and, by being screwed more or less tightly, allows the bar 39 to clamp the tape 2 against the pin, so as to apply friction to the tape and adjust its tension as required by the sewing machine 1.

The described magazine can be provided with an electronic device for automatic selection of the container to be used.

Figure 10:
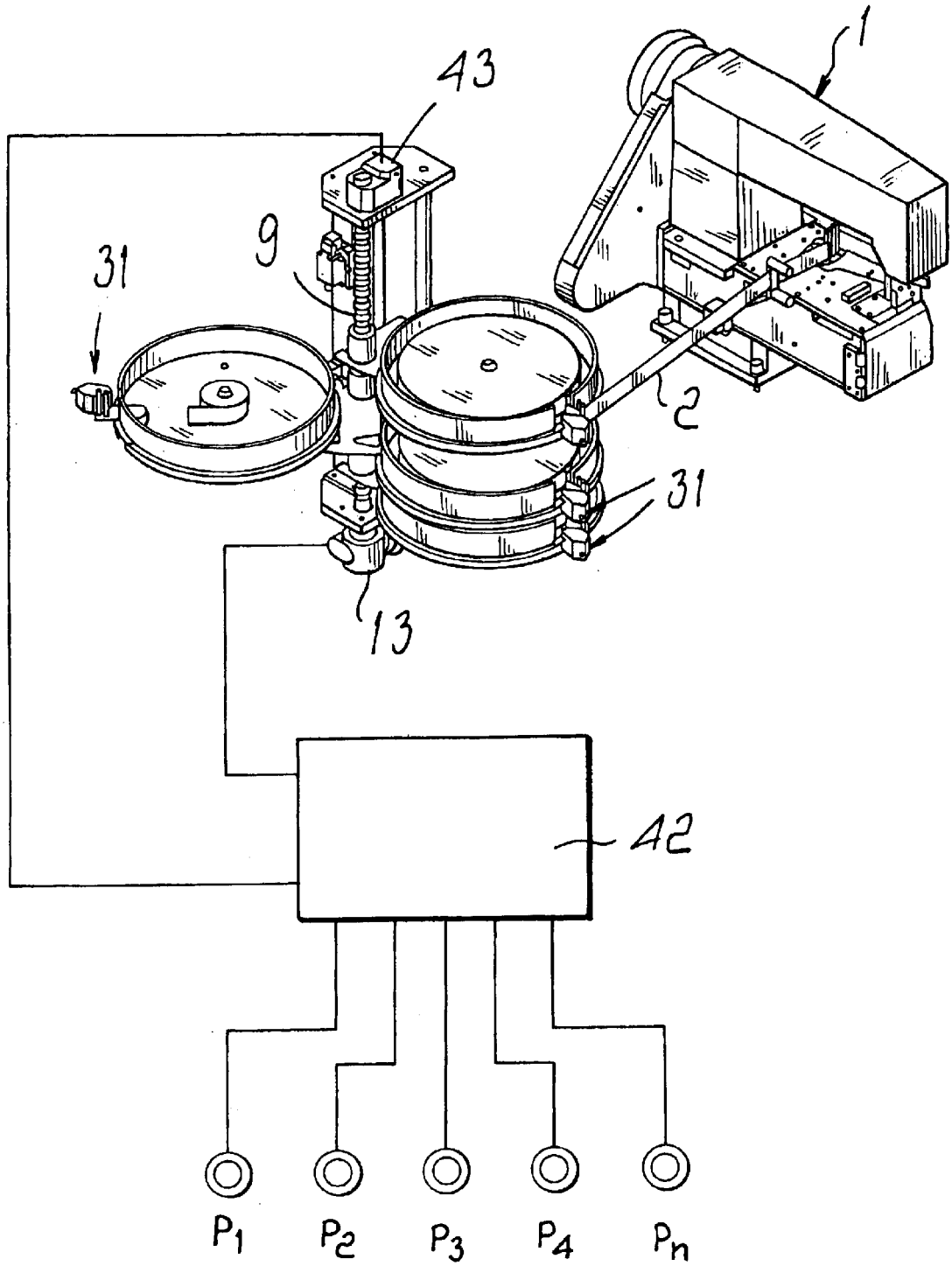
FIG. 10 is a view of a device for automatic selection of the reel to be used from the magazine.

As shown in FIG. 10, the device comprises a control unit 42 controlled by a plurality of buttons $P_1$, $P_2$, . . . $P_n$, each of which is associated with a value stored in memory which indicates the level of a respective support 4 along the guiding bar 8 and corresponds to the position of the container that contains the tape to be fed to the sewing machine.

The signal that indicates the real elevation of the containers is established by a potentiometer 43, installed on the bracket 6 and controlled by the threaded rod 9.

By acting on a button $P_1$, $P_2$, . . . $P_n$, the operating cycle of the gearmotor 13 is started, raising or lowering the stack of containers 26 until the signal supplied by the potentiometer 43 corresponds to the signal stored in the control unit 42, causing the threaded rod 9 to stop in the position in which the selected container is at the intended level.

The described magazine can be used both vertically, i.e., with a vertical stacking of the supports, and horizontally, i.e., with the supports arranged along a horizontal axis.

The disclosures in Italian Patent Application No. BO2001A000014 from which this application claims priority are incorporated herein by reference.

What is claimed is:

1. A magazine for a plurality of reels of tape, provided with a device for selecting a reel of tape to be used, comprising a plurality of supports for said reels, which can slide on a guide so that said reels form a stack whose axis is parallel to said guide, actuating means for actuating simultaneously said plurality of supports along said guide in order to position the reel of tape to be used in a preset point of said guide, each one of said supports comprising an arm, which can slide on said guide, and a container for a respective reel mounted on said arm, each said arm comprising a bush, which can slide on a guiding bar of said guide, and a female thread, which is engaged on a threaded rod of said guide that is parallel to said guiding bar and is actuated by a gearmotor assembly of the reversible type of said actuating means.

2. The magazine according to claim 1, wherein said sliding bush is constituted by two cylindrical half-shells, which are mutually articulated so as to assume a closed configuration for sliding on said bar, and an open configuration in order to allow rotation of said support about said threaded rod, said half-shells being associable in said closed configuration by threaded means.

3. The magazine according to claim 1, wherein said container is constituted by a circular plate, which is fixed to said arm and is provided with a central pin for the centering of a respective reel and with a cylindrical side wall that has a radial exit slit for the tape unwound from said reel.

4. The magazine according to claim 1, wherein said container is mounted on said arm so that it can be rotated out of said stack.

5. The magazine according to claim 1, wherein at an exit of each container a device for tensioning the dispensed tape is provided.

6. The magazine according to claim 5, wherein said device for tensioning is constituted by a presser, which is actuated by adjustable elastic means so as to clamp said tape against a fixed abutment and allow a friction-controlled unwinding of said tape.

7. The magazine according to claim 1, further comprising an electronic device for the automatic selection of a container to be used.

8. The magazine according to claim 7, wherein said electronic device comprises a control unit, which is provided with memory and is controlled by a plurality of selection buttons, each button being associated with a respective support and being suitable to select a value stored in said memory which indicates a level of a respective support along said guide, which corresponds to a position of the container that contains the tape to be used, said value being compared in said memory with a signal that indicates an actual level of the containers along said guide and is detected by a potentiometer controlled by said threaded rod so that, when said gearmotor is activated by acting on one of said selection buttons, said threaded rod turns and the stack of supports moves until the signal supplied by the potentiometer corresponds to the stored value, so as to stop the stack in the position in which the support of the container that contains the tape to be used is at an intended level.

* * * * *